US008556408B2

(12) United States Patent
Matsuya

(10) Patent No.: US 8,556,408 B2
(45) Date of Patent: Oct. 15, 2013

(54) MEDIUM PRESS DEVICE AND INK JET PRINTER

(75) Inventor: Naoki Matsuya, Chiba (JP)

(73) Assignee: Seiko I Infotech Inc. (JP)

( * ) Notice: Subject to any disclaimer, the term of this patent is extended or adjusted under 35 U.S.C. 154(b) by 434 days.

(21) Appl. No.: 12/735,624

(22) PCT Filed: Jan. 6, 2009

(86) PCT No.: PCT/JP2009/050043

§ 371 (c)(1),
(2), (4) Date: Oct. 12, 2010

(87) PCT Pub. No.: WO2009/098911

PCT Pub. Date: Aug. 13, 2009

(65) Prior Publication Data

US 2011/0025796 A1 Feb. 3, 2011

(30) Foreign Application Priority Data

Feb. 4, 2008 (JP) ..... 2008-024170

(51) Int. Cl.

| | |
|---|---|
| ***B41J 2/01*** | (2006.01) |
| ***B65H 3/52*** | (2006.01) |
| ***B65H 1/00*** | (2006.01) |

(52) U.S. Cl.

USPC ..... 347/104; 271/121; 271/145; 271/171

(58) Field of Classification Search

None

See application file for complete search history.

(56) References Cited

U.S. PATENT DOCUMENTS

| | | | | |
|---|---|---|---|---|
| 5,813,343 | A | 9/1998 | Harb | 101/407.1 |
| 2002/0180816 | A1 * | 12/2002 | Haflinger | 347/12 |
| 2007/0246879 | A1 * | 10/2007 | Sagawa et al. | 271/12 |
| 2007/0252883 | A1 * | 11/2007 | Ogimura | 347/104 |

FOREIGN PATENT DOCUMENTS

| | | |
|---|---|---|
| JP | 4069264 | 3/1992 |
| JP | 2003182911 | 7/2003 |
| JP | 2004090538 | 3/2004 |
| JP | 2006175818 | 7/2006 |

* cited by examiner

*Primary Examiner* — Stephen Meier
*Assistant Examiner* — Alexander C Witkowski
(74) *Attorney, Agent, or Firm* — Adams & Wilks

(57) ABSTRACT

A medium holding apparatus holds a medium to be transferred in a printer. A pair of holding members are mounted to undergo movement and are configured to continuously hold respective end sections of the medium in a width direction of the medium during transfer of the medium in the printer. A support structure supports the pair of holding members so that the pair of holding members are permitted to advance and retract in the width direction of the medium in accordance with positions of the end sections of the medium in the width direction.

22 Claims, 13 Drawing Sheets

30

30

130

MEDIUM PRESS DEVICE AND INK JET PRINTER

CROSS-REFERENCE TO RELATED APPLICATIONS

This application is a U.S. national stage application of International Application No. PCT/JP2009/050043 filed Jan. 6, 2009, claiming a priority date of Feb. 4, 2008, and published in a non-English language.

BACKGROUND OF THE INVENTION

1. Field of the Invention

The present invention relates to a medium press device for holding a medium conveyed in an ink jet printer and to an ink jet printer provided with the medium press device.

2. Background Information

It is known that in ink jet printers, a distance between an ink jet head ejecting ink and a medium largely influences on a print quality. The ink jet head is arranged to a printer chassis with good precision. Contrary to this, it is not a rare case that the medium to be carried may not keep a desired distance between the ink jet head due to occurrence of curling, existence of remaining cutting trash, attachment of foreign matter, and other factors. When conducting printing under such a state, it becomes difficult to control positions of ink droplets to be adhered onto the medium and the diameters of the droplets. As a result, there is a fear in that the print quality becomes unstable.

Contrary to this, in the conventional ink jet printer, there is proposed a mechanism for pressing a medium to be carried. For example, Patent Document 1 discloses a paper pressing mechanism including a pair of paper pressers for pressing lateral end portions of the paper to the platen. In the paper pressing mechanism, the paper pressers may be fixed to positions in accordance with a width of the paper by using setting screws. With this, the paper is pressed during printing to secure the distance between the ink jet head.

On the other hand, Patent Document 2 discloses a paper pressing mechanism including a pair of press clamps slidably provided on the platen. In the paper pressing mechanism, by depressing a press knob, a plate spring floats to thereby facilitate the insertion of end portions in a width direction of the printing paper, and by releasing the pressing force of the pressing knob, it is possible to press the end portions in the width direction of the paper.

[Patent Document 1] Japanese. Patent Application Laid-open No. Hei 4-69264

[Patent Document 2] Japanese Patent Application Laid-open No. 2004-90538

However, in the paper presser of Patent Document 1, the pressing mechanism is fixed during the paper conveyance, and hence in the case of abnormal conveyances such as the paper is slantly conveyed with respect to an intrinsic conveying direction, a zigzag conveyance case, or the other cases, the end portions of the paper may dislodge from the pressing mechanism, the end portions may bump to curl up, or may interfere with the ink jet head. In those cases, the distance with the ink jet head may not be kept, or there is a fear of becoming difficult to continue the conveyance.

On the other hand, in the press cramp of Patent Document 2, there is employed the structure in which after the insertion of printing paper, the pressing pressure of the pressing knob is released to press the end portions in the width direction of the paper against the platen side. As a result, similar to the paper presser of Patent Document 1, in the case where the paper is conveyed slantly, or the zigzag movement, the end portions of the paper may dislodge from the pressing mechanism, the end portions may bump to curl up, or may interfere with the ink jet head. In addition, in the press cramps of Patent Document 2, in the case where, along with the slant movement of the paper, etc., the press cramps are moved outside the paper in the width direction, the press cramps do not return to their original positions, and hence it becomes difficult to press the end portions of the paper to be conveyed later.

Contrary to this, a holding force by the pressing mechanism is enhanced, thereby being capable of forcedly pressing the paper at the time of the abnormal conveyance. However, in this case, frictional resistance is applied to the paper under conveyance, there is a risk of breaking the paper. This becomes markedly if the paper is conveyed slantly or in zigzag.

Contrary to this, a holding force by the pressing mechanism is enhanced, thereby being capable of forcedly pressing the paper at the time of the abnormal conveyance. However, in this case, a frictional resistance is applied to the paper under conveyance, and thus there is a risk of breaking the paper. This risk increases if the paper is conveyed slantly or in a zigzag manner.

On the other hand, in the case where the gap between the pressing mechanism and the paper is increased and the holding force by the pressing mechanism is weakened, the paper may be conveyed smoothly even if the paper is conveyed slantly or in a zigzag manner. However, as the holding force is weak, the gap between the ink jet head and the paper is not constant, resulting in degradation of the printing quality due to possible displacements of adhering positions of the ink ejected from the ink jet head.

SUMMARY OF THE INVENTION

It is therefore an object of the present invention to provide a medium press device capable of positively holding both ends of a recording medium (hereafter referred to as "medium"), such as printing paper or the like, in the width direction thereof, irrespective of a conveying state of the medium, and to an ink jet printer provided with such medium press device. In other words, an object of the present invention is to provide a medium press device capable of continuously pressing side end portions (hereafter referred to as "end portions") of a recording medium even if the medium is conveyed slantly or in zigzag, and, with this, capable of maintaining a gap between the ink jet head and the medium into a desired gap to keep a printing quality uniform, and an to ink jet printer provided with such medium press device.

MEANS FOR SOLVING THE PROBLEMS

In order to solve the above-mentioned problems, according to the present invention, a medium press device for holding a medium conveyed in an ink jet printer, is characterized by including: a pair of press members for holding both ends of a width direction of the medium, respectively; and support tools for supporting the pair of press members, and is characterized in that the support tools support the press members so as to be capable of advancing and retreating in the width direction of the medium in alignment with positions of end portions of the width direction of the medium.

In the medium press device having the above-mentioned structure, it is preferred that each of the support tools include: an elastically deformable elastic support member; and a hold tool for holding the elastic support member, and that each of the support tools support the press member so as to be capable of advancing and retreating in the width direction of the medium through an elastic force provided to the elastic support member.

It is preferred that the hold tool maintain its position when a force received from the medium is within a predetermined range, and is slidable in the width direction of the medium when the force received from the medium exceeds the predetermined range, and that the hold tool include a hold member which is juxtaposed with the press member, in the width direction of the medium, through intermediation of the elastic support member.

Further, it is preferred that the hold tool include a gap restriction member for regulating a gap between the press member and the hold member, and further include the elastic restriction member which is elastically deformable in the width direction of the medium, and the elastic restriction member regulate a sliding range of the gap restriction member through the elastic force.

The pair of press members provided to the medium press device of the present invention is regulated in its sliding in the width direction of the medium through a resultant force of the elastic force of the elastic restriction member and a frictional force between the elastic restriction member and a movement restriction member which is provided to the ink jet printer, and when the force received from the medium exceeds the resultant force, the press member may slide in the width direction of the medium.

In the medium press device thus constructed, it is preferred that the elastic restriction member is received within a groove portion provided to the movement restriction member in a state abutting against an inner wall so that the frictional force is produced between the inner wall. In this case, the movement restriction member may be a platen.

As the elastic support member, a spring having elasticity in the width direction of the medium may be chosen, and the spring processed into a linear shape is preferred.

Further, an ink jet printer according to the present invention includes: a medium conveying device for conveying a medium; an ink jet head for discharging ink to the medium; and a medium press device for holding the medium, and is characterized in that: the medium press device includes: a pair of press members for holding both ends of the width direction of the medium, respectively; and support tools for supporting the pair of press members, and that the support tools support the press members so as to be capable of advancing and retreating in the width direction of the medium in alignment with positions of end portions of the width direction of the medium.

EFFECT OF THE INVENTION

According to the present invention, the pair of press members for holding the both ends of the width direction of the medium and the support tools for supporting the pair of press members are provided, and the support tools support the press members so as to be capable of advancing and retreating in the width direction of the medium in alignment with positions of end portions of the width direction of the medium. As a result, even in a case where a medium is conveyed diagonally or in a zigzag line, it is possible to keep pressing the ends of the medium, whereby it is possible to maintain a gap between the ink jet head and the medium to a desired gap to keep a printing quality constant.

DETAILED DESCRIPTION OF THE PREFERRED EMBODIMENT

Hereinafter, detailed descriptions are made of a medium press device and an ink jet printer according to embodiments of the present invention with reference to drawings.

Figure 1:
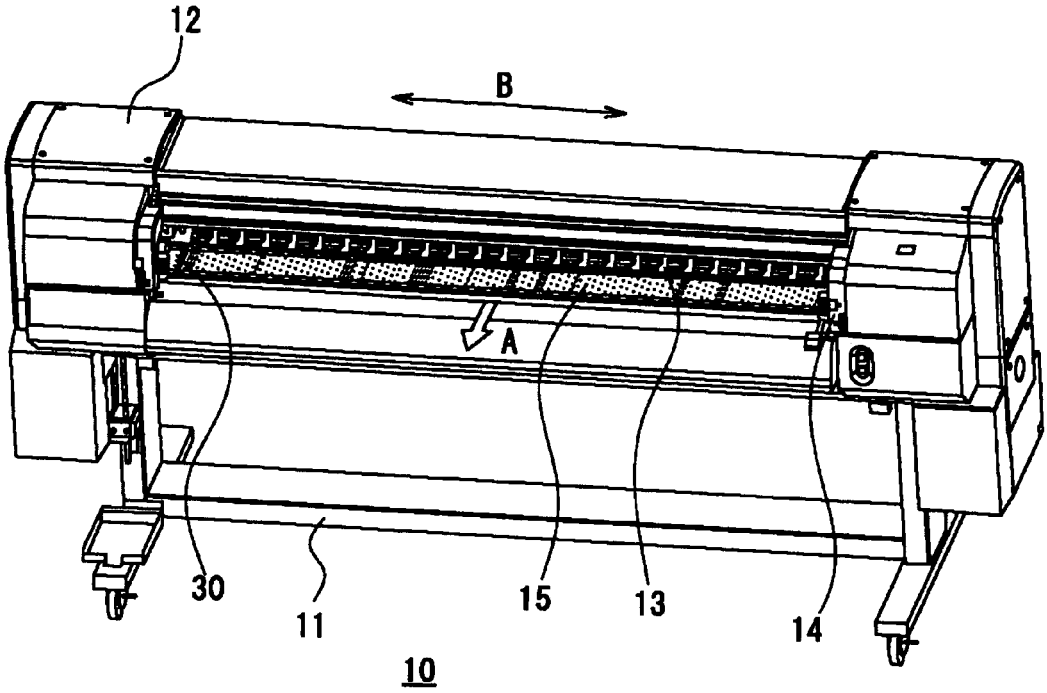
FIG. 1 A perspective view illustrating the structure of an ink jet printer according to an embodiment of the present invention.

First, while referring to FIG. 1, an overall structure of an ink jet printer 10 according to this embodiment is described. Here, FIG. 1 is a perspective view illustrating the structure of the ink jet printer 10, which is viewed from a front upper direction.

The ink jet printer 10 includes at least, within a main body 12 disposed on a movable base 11, a medium conveying mechanism 13, an ink jet head 14, a platen 15, and a medium press device (medium holding apparatus) 30. Note that, in the following description, a width direction of the medium refers to a direction B, which is orthogonal to a medium conveying direction A of FIG. 1.

The medium conveying mechanism 13 feeds the medium on which printing is performed to a predetermined printing position between the ink jet head 14 and the platen 15, and discharges the medium which has been printed by the ink jet head 14. Here, the medium on which printing by the ink jet is performed includes, for example, paper, a cloth, and a plastic sheet.

The ink jet head 14 includes a predetermined number of nozzles for ejecting ink downward with respect to the medium fed by the medium conveying mechanism 13. The ink is ejected from one or two or more of the nozzles in accordance with an image to be printed. On the medium, by repeating the ink ejection and the conveying of the medium, a desired image is formed. Note that, the structures of the base 11, the main body 12, the medium conveying mechanism 13, and the ink jet head 14 are well known, and hence detailed description thereof is omitted.

Figure 2:
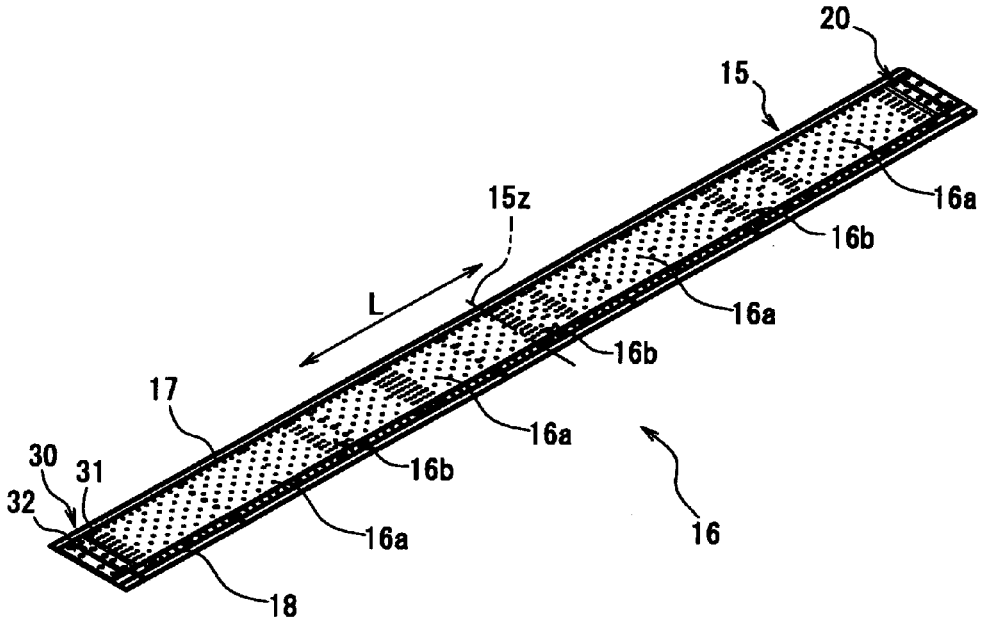
FIG. 2 A perspective view illustrating the structures of a platen and a medium press device according to an embodiment of the present invention.

The platen 15 has a long plate shape, and is provided below the ink jet head 14 so that a longitudinal direction L thereof is in parallel with a width direction B of the medium. As illustrated in FIG. 2, the suction holes 16*a* are formed in the platen 15. Here, FIG. 2 is a perspective view viewed from front upper, and illustrates the structures of the platen 15 and the medium press device 30. The suction holes 16*a* are formed so as to penetrate the platen 15 in a thickness direction, and pressures within the holes are made negative through an operation of a suction device (not shown) provided in the main body 12, whereby the medium being conveyed on the platen 15 may be sucked. The suction force by the suction holes 16*a* is set so that the medium is not prevented from being conveyed, and the medium and the ink jet head 14 are kept at a predetermined gap. The suction holes 16*a* may have an arbitrary shape, and may be arbitrarily arranged, but the width of the medium is generally standardized. Accordingly, it is preferred to provide congest-arranged holes 16*b*, in which the suction holes 16*a* are congested and more closely arranged than in other places, at positions in the vicinity of widths of a plurality of media that may be assumed in advance. This is to bring the end portions of the medium into close contact with the platen 15 so that the end portions of the medium are hard to curl up.

On both end sides of the longitudinal direction L or the platen 15, the medium press devices (medium holding apparatuses) 20 and 30 are arranged, respectively. In the platen 15, two groove portions 17 and 18 are formed so as to extend in the longitudinal direction L. The medium press devices 20 and 30 are movable in the longitudinal direction L in sliding contact with inner walls of the groove portions 17 and 18. Opening portions of the groove portions 17 and 18 are narrower than bottom portions thereof so that the medium press devices 20 and 30 are free from being dislodged from the opening portions. The medium press devices 20 and 30 have the same structure, and are provided symmetric with respect to a center line 15*z* in the longitudinal direction L of the platen 15 to hold the both ends of the width direction of the medium. In the following description, only the medium press device 30 is described, and the detailed description of the medium press device 20 is omitted.

Figure 3:
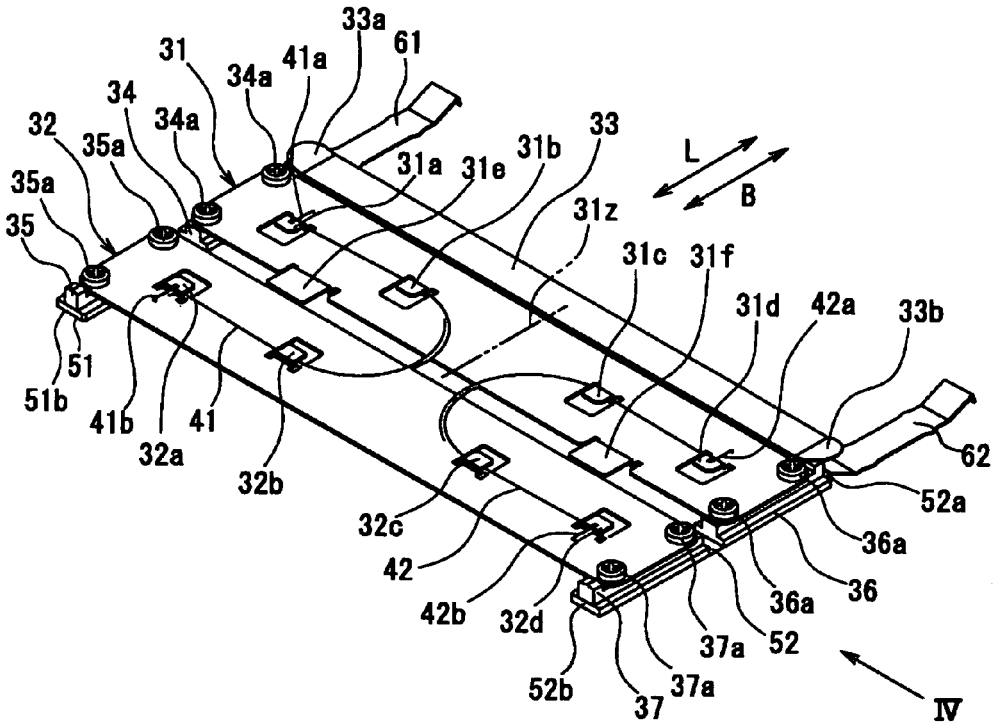
FIG. 3 A perspective view illustrating the structure of the medium press device according to the embodiment of the Present invention.

The medium press device 30 includes, as illustrated in FIG. 3, a first plate 31, a second plate 32, slider blocks 34, 35, 36, and 37, wire working springs 41 and 42, stopper blades 51 and 52, and plate springs 61 and 62. Here, FIG. 3 is a perspective view viewed from upper, for illustrating the structure of the medium press device 30. The second plate 32, the slider blocks 34, 35, 36, and 37, the wire working springs 41 and 42, the stopper blades 51 and 52, and the plate springs 61 and 62 constitute a support or supporting tool. Further, the second plate 32, the slider blocks 34, 35, 36, and 37, the stopper blades 51 and 52, and the plate springs 61 and 62 constitute a hold tool. The medium press device 30 holds the medium conveyed in the ink jet printer 10, and the support tool supports the first plate 31 and a medium press portion 33 as one press member of the pair of the press members or holding members so as to be capable of advancing and retreating in the width direction of the medium in alignment with a position of the end portion.

Hereinafter, description is made of respective members constituting the medium press device 30.

The first plate 31 and the second plate 32 as the hold member are each long plate shape members made of metals, such as stainless plate, for example. As illustrated in FIG. 2, from an inner side to an outer side in the longitudinal direction L of the platen 15, the first plate 31 and the second plate 32 are arranged in parallel with each other in the stated order. Note that, as described hereinbelow, it is preferred that the members constituting the medium press device 30 be all constructed of metal. In this manner, when all the members are constructed of metal, compared with a case of constructing the members using a resin, influences due to temperature rise of the platen 15 or influences due to solvents constituting ink are less likely to occur thereby metal as the material being preferred.

As illustrated in FIG. 3, on an upper surface of the first plate 31, engagement portions 31*a*, 31*b*, 31*c*, and 31*d* are provided in the stated order in the longitudinal direction. The engagement portions 31*a* and the engagement portions 31*b* and the engagement portions 31*c* and the engagement portion 31*d* are arranged symmetric with respect to a center line 31*z* in the longitudinal direction of the first plate 31. On an upper surface of the second plate 32, engagement portions 32*a*, 32*b*, 32*c*, and 32*d* are provided in the longitudinal direction in the stated order so as to correspond to the engagement portions 31*a*, 31*b*, 31*c*, and 31*d*, respectively.

Wire working springs 41 and 42 as elastic support members are linearly-processed metal members having the same shape, and are constructed of, for example, a steel wire for springs, which being one kind of a piano wire. As illustrated in FIG. 3, by bending the wire working springs into a U-shape, there is obtained an elastic force with which the spring tends to return to a straight line. As for the wire working spring 41, one end portion 41*a* is inserted and held into/by the engagement portions 31*a* of the first plate 31, and another end portion 41*b* is inserted and held into/by the engagement portions 32*a* of the second plate 32. In addition, midways between those end portions are held by the engagement portions 31*b* and 32*b*, whereby the wire working spring 41 is bent into the U-shape and held on the first plate 31 and the second plate 32.

As for the wire working spring 42, as well as the wire working spring 41, one end portion 42*a* is inserted and held into/by the engagement portion 31*d* of the first plate 31, and also another end portion 42*b* is inserted and held into/by the engagement portion 32*d* of the second plate 32. In addition, midways between those end portions are held by the engagement portions 31*c* and 32*c*, whereby the wire working spring 42 is bent into the U-shape on the first plate 31 and the second plate 32.

Both the wire working spring 41 and the wire working spring 42 have the U-shape in which the end portion sides in the longitudinal direction of the first plate 31 and the second plate 32 are opened, thereby being expandable in the width directions of the first plate 31 and the second plate 2, namely, in the width direction B of the medium. The wire working spring 41 and the wire working spring 42 are caused to have the U-shape described above, and the both ends thereof are held by the first plate 31 and the second plate 32. As a result, in the width direction B of the medium, an elastic force caused by the wire working spring 41 and the wire working spring 42 may be applied between the first plate 31 and the second plate 32. Further, if the wire working spring is used as the elastic support member, the elastic force may easily be set finely, and even if the wire working spring is arranged on the first plate 31 and the second plate 32, the sizes in the thickness direction thereof may not be changed. In addition, the wire working springs 41 and 42 may only be mounted on the first plate 31 and the second plate 32, and hence by forming groove portions similar to the groove portions 17 and 18 of this embodiment, the platen of a type in which the medium press member is held, may be used without modification.

Figure 4:
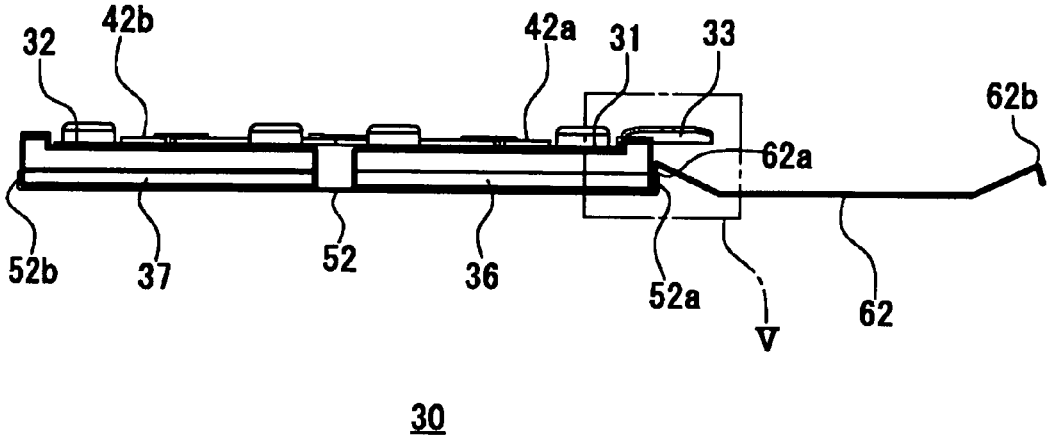
FIG. 4 A side view illustrating the structure of the medium press device according to the embodiment of the present invention, which is viewed from a IV direction of FIG. 3.
Figure 5:
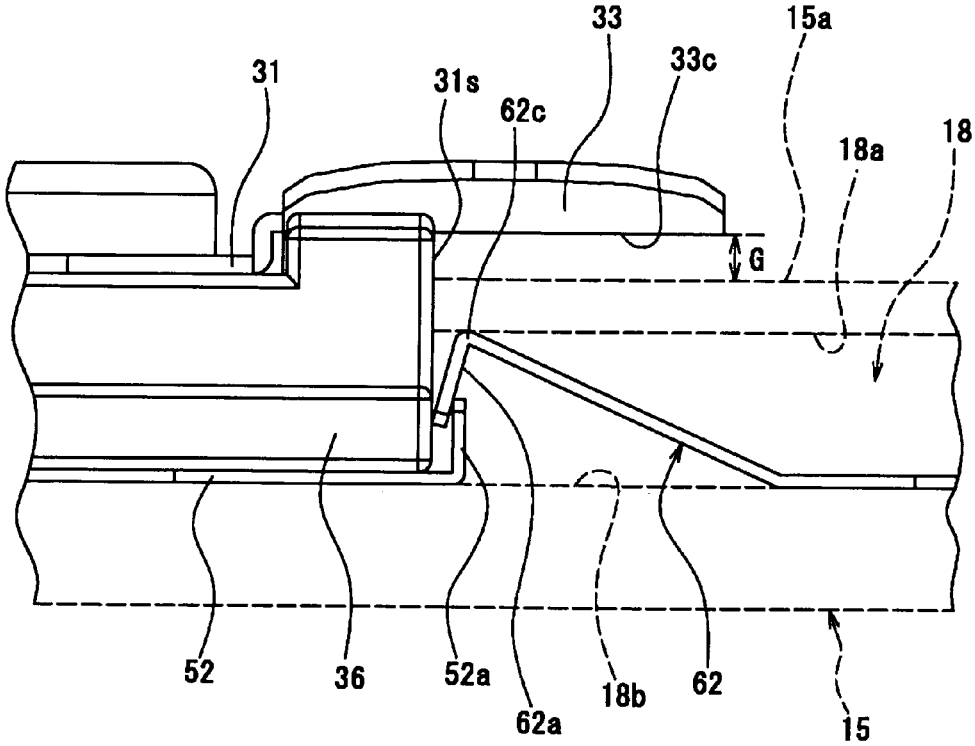
FIG. 5 An enlarged view of a V portion of FIG. 4, illustrating an engagement state of a plate spring according to an embodiment of the present invention.

On the first plate 31, there is formed the medium press portion (medium press member) 33 along a long side which is far from the first plate 31. The medium press portion 33 is formed through bending the second plate 32. Note that, the medium press portion 33 may be formed by welding or bonding the medium press member which is a separate body to the first plate 31. As illustrated in FIG. 4 and FIG. 5, the medium press portion 33 is formed so as to extend in a direction separating from the second plate 32 at a position higher than the top surface of the first plate 31. The medium press portion 33 presses downward, namely, on the platen 15 side the end portion of the width direction B of the medium to be conveyed by sandwiching it between, with a gap G as illustrated in FIG. 5, a lower surface 33*c* of the medium press portion 33 and an upper surface of the platen 15, receives a side surface within a space extending 31*a* of the first plate 31. Here, FIG. 4 is a side view illustrating the structure of the medium press device 30, which is viewed from a IV direction of FIG. 3. FIG. 5 is an enlarged side view of a V portion of FIG. 4 illustrating an engagement state of the plate spring 62 with respect to the stopper blades 52. In FIG. 5, the platen 15 is illustrated by a dotted line for illustrating a relation with the platen 15 when the medium press device 30 is mounted to the ink jet printer 10.

Further, medium guide portions 33*a* and 33*b* which are slanted upwardly as approaching to tips thereof are formed at the both ends in the longitudinal direction of the medium press portion 33, respectively. The medium guide portion 33*a* facilitates the introduction of the medium conveyed to the platen 15 into a lower side of the medium press portion 33, and the medium guide portion 33*b* facilitates the discharge of the medium after printing.

Figure 12:
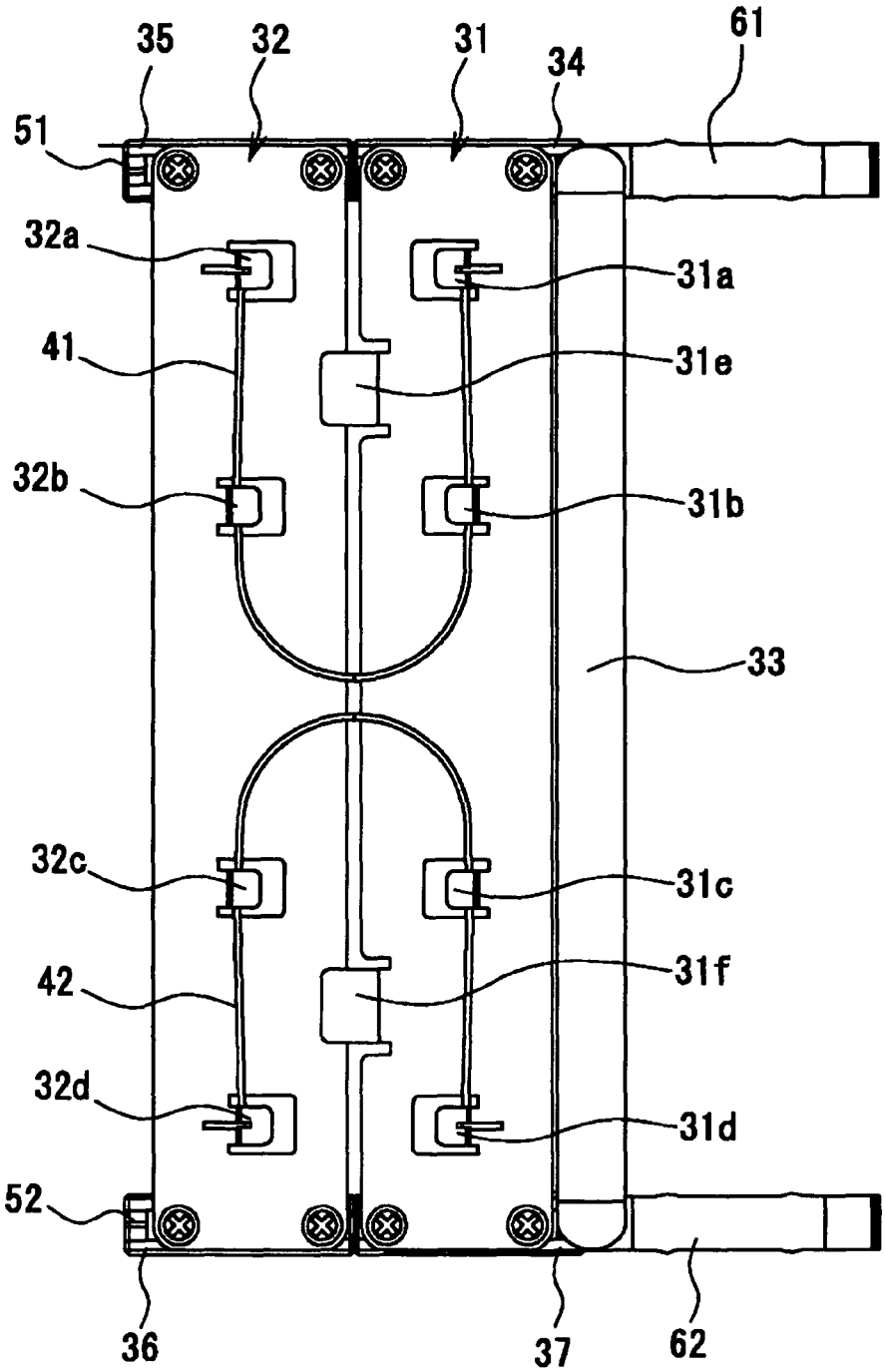
FIG. 12 A plan view illustrating the structure of the medium press device in a state in which the first plate and the second plate are closed with each other when the outside force causing the first plate to a roach to the second plate is applied.

Further, as illustrated in FIG. 3, tilting pieces 31*e* and 31*f* are formed at a long side on the second plate 32 side of the first plate 31. The tilting pieces 31*e* and 31*f* are formed so as to protrude toward the second plate 32 side at symmetrical positions with respect to a center line 31*z* of the first plate 31. The tilting pieces 31*e* and 31*f* are provided so as to extend over the upper surface of the second plate 32 so that the first plate 31 is prevented from colliding with the second plate 32 when the first plate 31 and the second plate 32 are caused to approach with each other against an elastic force of the wire working spring 41 and the wire working spring 42 (FIG. 12). When a user of the ink jet printer 10 depresses the tilting pieces 31*e* and 31*f* downwardly, the medium press portion 33 moves upward. As a result, the insertion of the medium into the under the medium press portion 33 is facilitated.

As illustrated in FIG. 3, the slider blocks 34 and 36 are fixed to the both ends of the longitudinal direction of the first plate 31 at the lower surface thereof, respectively. The slider blocks 34 and 36 are metal members having a same shape with each other and formed of an aluminium material, for example, and respective slider blocks 34 and 36 are fixed at the both ends of the longitudinal direction of the first plate 31 with screws 34*a* and 36*a*, so as to extend toward the width direction of the first plate 31. Further, the slider blocks 35 and 37 each are fixed to the both ends of the longitudinal direction at the lower surface of the second plate 32. The slider blocks 35 and 37 are metal members having the same shape with the slider blocks 34 and 36 fixed to the first plate 31 and formed of an aluminium material, for example, and respective slider blocks 35 and 37 are fixed at the both ends of the longitudinal direction of the second plate 32 with screws 35*a* and 37*a*, so as to extend toward the width direction of the second plate 32. Note that, the slider blocks 34, 35, 36, and 37 may be formed of plastic material.

Figure 6:
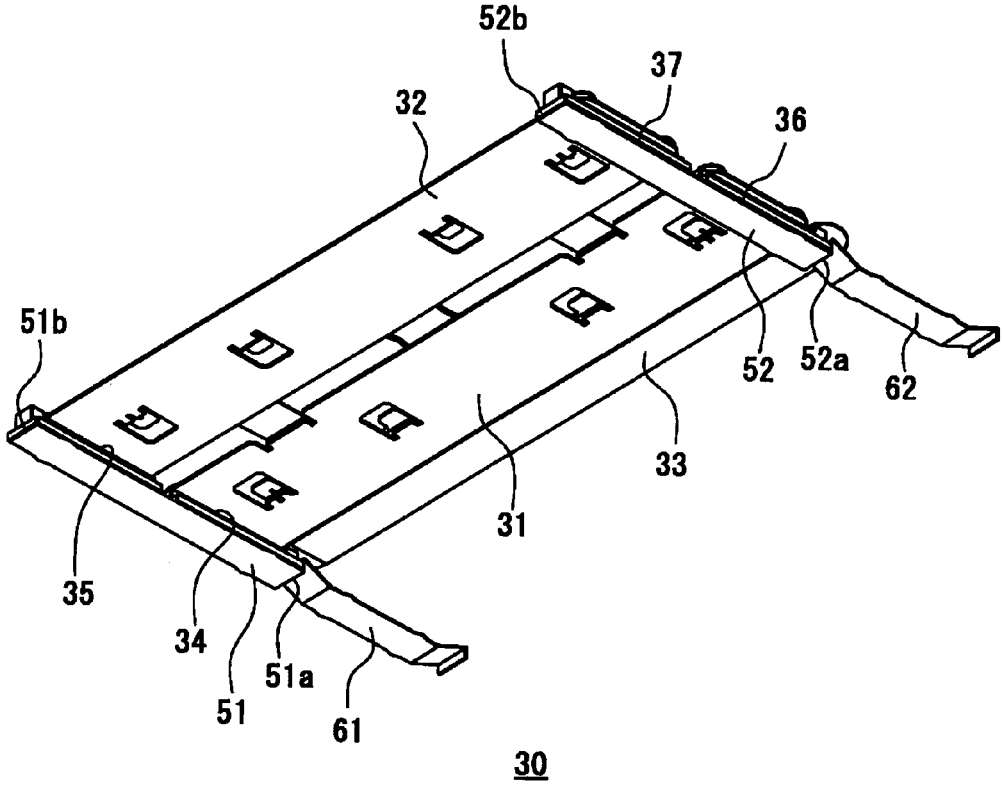
FIG. 6 A perspective view illustrating the structure of the medium press device according to the embodiment of the present invention.

As illustrated in FIG. 3, the slider blocks 34 and 35 are mounted on the stopper blades 51, and the slider blocks 36 and 37 are mounted on the stopper blades 52, respectively. The stopper blades 51 and 52 as the gap restriction members are members obtained by processing the both end portions of the longitudinal direction of the long plate shape member made of metal so as to bend upwardly, are formed of a stainless plate, for example, and have a same shape. The stopper blade 51 has a substantially same width with the slider blocks 34 and 35. The distance between the movement restriction portions 51*a* and 51*b* (refer to FIG. 6), which are formed by bending the both ends of the stopper blades 51, is larger than the length of the slider block 34 and the slider block 35 which are aligned in the longitudinal direction. With this, the slider block 34 and the slider block 35 are movable on the stopper blades 51 until being brought into contact with the movement restriction portion 51*a* or the movement restriction portion 51*b*. Here, FIG. 6 is a perspective view illustrating the structure of the medium press device 30, which is viewed from below. The length of each of the stopper blades 51 and 52 corresponds to a slidable amount of the first plate 31, and may be determined based on a movable tolerance of the end portion of the width direction of the medium.

Similar to the stopper blades 51, the stopper blades 52 has a substantially same width with the slider blocks 36 and 37, on the other hand, the distance between the movement restriction portions 52*a* and 52*b*, which are formed by bending the both ends of the stopper blades 52, is larger than the length of the slider blocks 36 and the slider block 37 which are aligned in the longitudinal direction. With this, the slider block 36 and the slider block 37 are movable on the stopper blades 52 until being brought into contact with the movement restriction portion 52*a* or the movement restriction portion 52*b*.

The slider blocks 34, 35, 36, and 37 and the stopper blades 51 and 52 are constructed as described above. As a result, the first plate 31 and the second plate 32 become a state of separating from each other, in a natural state of being not applied with an outer force, due to an elastic force of the wire working springs 41 and 42, under a state in which the slider block 34 is brought into contact with the movement restriction portion 51*a*, the slider block 35 is brought into contact with the movement restriction portion 51*b*, the slider block 36 is brought into contact with the movement restriction portion 52*a*, and the slider block 37 is brought into contact with the movement restriction portion 52*b*, respectively. Contrary to this, when the first plate 31 is caused to move toward the second plate 32 side against the elastic force of the wire working springs 41 and 42, together with the first plate 31, the slider block 34 moves on the stopper blades 51, and the slider block 36 moves on the stopper blades 52, respectively. Therefore, for example, the medium, which is normally conveyed, may be pressed with the first plate 31 and the second plate 32 of the natural state, whereas in the case where the medium is conveyed slantly to cause an end portion of the medium in the width direction is moved outside, the first plate 31 is caused to move toward the second plate 32 side by a force generated by the movement of the medium toward outside, thereby being capable of continuously pressing the medium.

As illustrated in FIG. 6, the plate springs 61 and 62 as the elastic restriction member are engaged to the movement restriction portion 51*a* of the stopper blades 51 and the movement restriction portion 52*a* of the stopper blades 52. The plate springs 61 and 62 are metal members having the same shape and formed of a stainless plate, for example, and engagement methods to the stopper blades 51 and 52 are the same. Accordingly, in the following description, description is made of the plate spring 62, and description of the plate spring 61 is omitted.

As illustrated in FIG. 4, the plate spring 62 is a long plate shape member having a substantially same width with the slider blocks 36, 37, and the stopper blades 52, and the both ends of the longitudinal direction thereof is bent toward the lower side to form the engagement portion 62*a* and the bending portion 62*b*, respectively. The engagement portion 62*a* of the plate spring 62 is engaged with the movement restriction portion 52*a* of the stopper blades 52.

Note that, the stopper blades 51 and 52, and the plate springs 61 and 62 may be formed as an integral member, respectively. However, as in the embodiment described above, if they are formed as a separate member, deformations of the plate springs 61 and 62 do not hinder the slides of the slider blocks 34, 35, 36, and 37 on the stopper blades 51 and 52, thereby being preferred.

Figure 7:
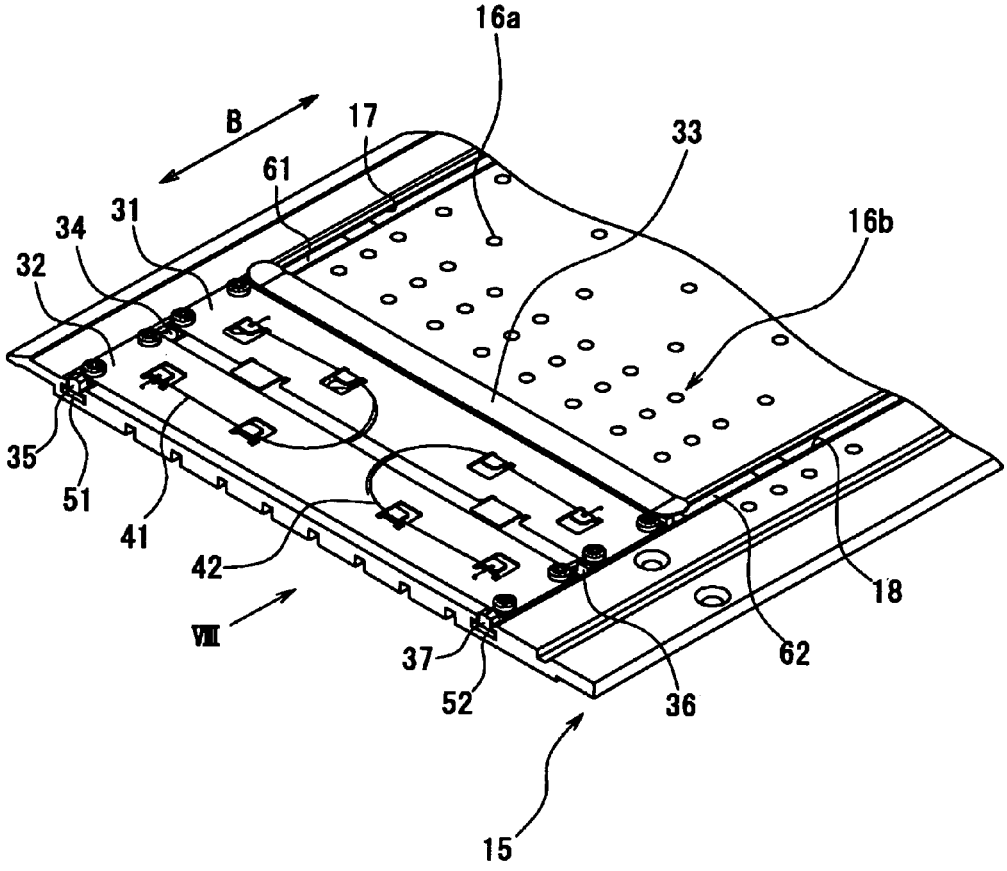
FIG. 7 A perspective view illustrating a state in which the medium press device according to the embodiment of the resent invention is movably arranged with respect to the platen.
Figure 8:
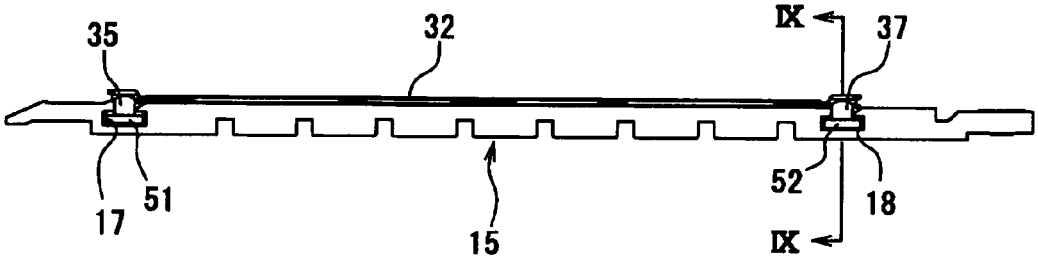
FIG. 8 A side view illustrating a state in which the medium press device according to the embodiment of the present invention is movably arranged with respect to the platen which is viewed from a VIII direction of FIG. 7.

As illustrated in FIG. 7 and FIG. 8, the stopper blades 51, the slider blocks 34 and 35 mounted on the stopper blades 51, and the plate spring 61 engaged to the stopper blades 51 are slidably received within the groove portions 17 recessed along the width direction B of the medium in the platen 15 as the movement restriction member. Similarly, the stopper blades 52, the slider blocks 36 and 37 mounted on the stopper blades 52, and the plate spring 62 engaged with the stopper blades 52 are received within the groove portions 18 recessed in parallel with the groove portions 17 in the platen 15. Here, FIG. 7 is a perspective view illustrating a state in which the medium press device 30 is movably arranged with respect to the platen 15, which is viewed from above. FIG. 8 is a side view illustrating a state in which the medium press device 30 is movably arranged with respect to the platen 15, which is viewed from a VIII direction of FIG. 7.

Figure 9:
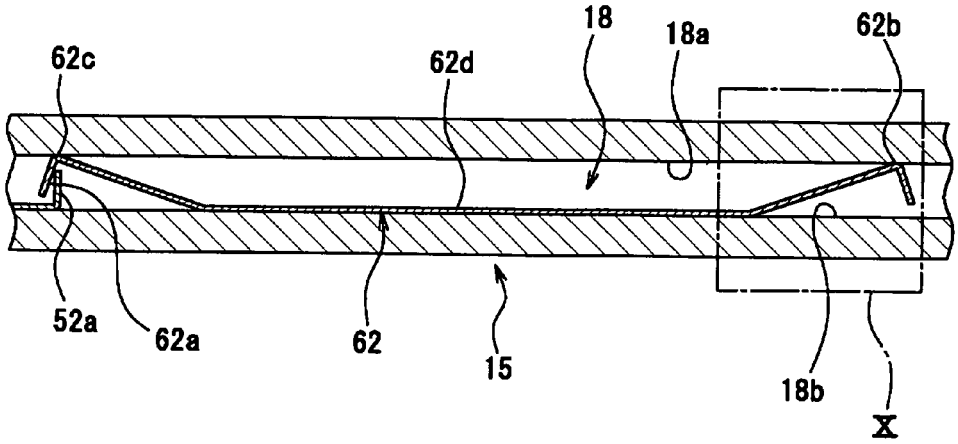
FIG. 9 A sectional view taken along the line IX-IX of FIG. 8, illustrating an abutting state between an inner wall of groove portion according to an embodiment of the present invention and a plate spring.
Figure 10:
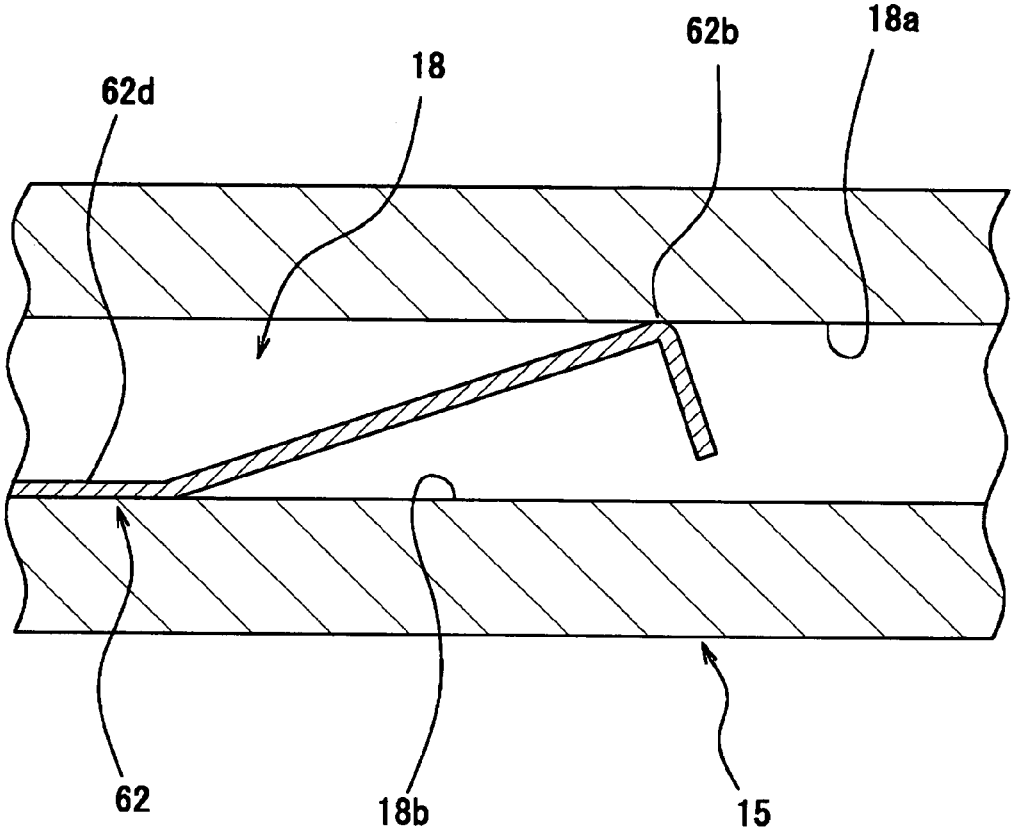
FIG. 10 An enlarged sectional view taken along the line X-X of F 9 illustrating the abutting state between the inner wall of the groove portion according to the embodiment of the present invention and the plate spring.

As illustrated in FIG. 9 and FIG. 10, a bending portion 62 forming the engagement portion 62*a* of the plate spring 62, and the bending portion 62*b* on the end portion side of the other side of the plate spring 62 abut against an upper wall 18*a* of the groove portions 18. Further, a flat plate portion 62*d* of a center of the longitudinal direction of the groove portions 18 abuts against the bottom wall 18*b* of the groove portions 18. Here, FIG. 9 is a sectional view taken along the line IX-IX of FIG. 8, illustrating an abutting state between an inner wall of the groove portion 18 and the plate spring 62. FIG. 10 is an enlarged sectional view taken along the line X-X of FIG. 9, illustrating the abutting state between the inner wall of the groove portion 18 and the bending portion 62*b* side of the plate spring 62.

As stated above, the bending portions 62*b* and 62*c* of the plate spring 62 are caused to abut against the upper wall 18*a* of the groove portions 18, the flat plate portion 62*d* is caused to abut against the bottom wall 18*b* of the groove portions 18, respectively. As a result, a frictional force is generated between the plate spring 62 and the inner wall of the groove portions 18, and hence by the frictional force and the elastic force of the plate spring 62, the movement of the stopper blades 52 engaged to the plate spring 62 within the groove portions 18 may be restricted. This is the same with the plate spring 61 received within the groove portions 17.

Figure 11:
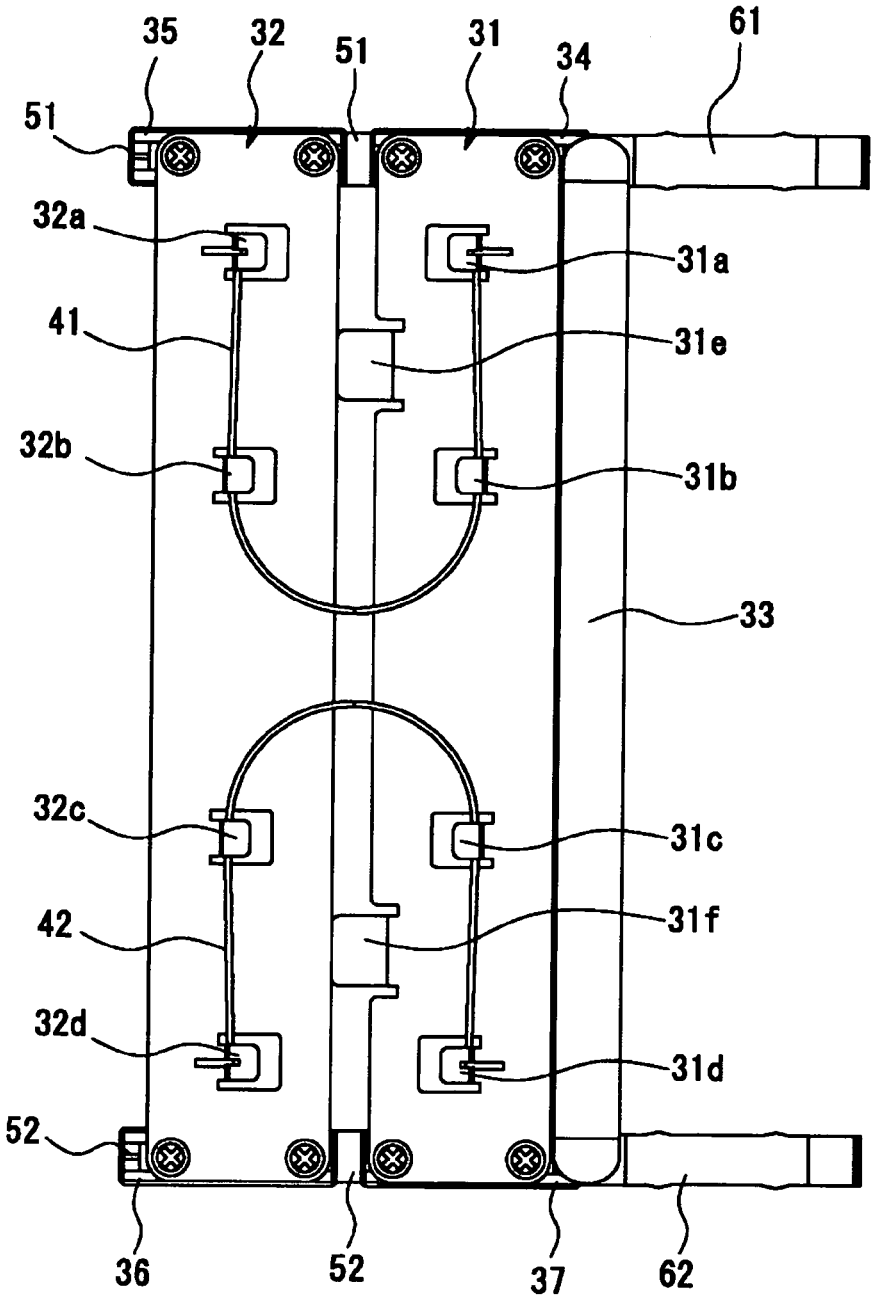
FIG. 11 A plan view illustrating the structure of the medium press device in a state in which a first plate and second plate are spaced apart from each other when a wire working spring according to an embodiment of the resent invention is free from an outside force.

In the medium press device 30 thus constructed, first, in a state in which the medium is normally conveyed, the first plate 31 is separated from the second plate 32 by an elastic force of the wire working spring 41 and the wire working spring 42 which tend to expand in the width direction B of the medium, (FIG. 11). Contrary to this, when the position of the end portion in the width direction of the medium expands outside due to reasons such as being conveyed slantly, the first plate 31 moves toward the second plate 32 side against the elastic force of the wire working spring 41 and the wire working spring 42 (FIG. 12). Here, if the resultant force as a sum of the elastic force of the plate spring 62 and the frictional force between the plate spring 62 and the inner wall of the groove portion 18 is made larger than the elastic force of the wire working springs 41 and 42, during the movement of the first plate 31 toward the second plate 32 side, the second plate 32 applied with an elastic force that tends to expand outside, which is received from the wire working spring 41 and the wire working spring 42, may be latched to its original position. This is the same with the plate spring 61. Thus, even in the case where the position in the width direction of the medium is moved outside and then returned to a normal convey, the first plate 31 may follow the end portion of the width direction of the medium, whereby the medium press device 30 may always press the end portion in the width direction of the medium.

In addition, in the case where the position in the width direction of the medium is so extremely displaced outside as a force exceeding the sum of the elastic force of the plate spring 62 and the frictional force between the plate spring 62 and the inner wall of the groove portions 18 is generated, the entire medium press device 30 may be moved. With this, the breakage of the medium may be prevented. In other words, when the force from the medium and received by the medium press device 30 falls within a predetermined range which is determined by the sum of the elastic force of the plate spring 62 and the frictional force between the plate spring 62 and the inner wall of the groove portion 18, the position of the second plate 32 is maintained, whereas when the force received from the medium exceeds the above-mentioned predetermined range, the entire medium press device 30 is allowed to slide in the width direction of the medium. Here, FIG. 11 is a plan view illustrating the structure of the medium press device 30 in a state in which the first plate 31 and the second plate 32 are spaced apart from each other when the wire working springs 41 and 42 are free from an outside force. FIG. 12 is a plan view illustrating the structure of the medium press device 30 in a state in which the first plate 31 and the second plate 32 are closed with each other when the outside force causing the first plate 31 to approach to the second plate 32 is applied When printing, the ink jet head 14 passes above the medium press device 30. In the medium press device 30, the medium press portion 33 is disposed at the highest position, namely, at a place close to the ink jet head 14, and the wire working springs 41 and 42, the engagement portions 31*a*, 31*b*, 31*c*, and 31*d* of the first plate 31, and the engagement portions 32*a*, 32*b*, 32*c*, and 32*d* of the second plate 32 are arranged at the lower positions than the medium press portion 33, namely, at the positions far from the ink jet head 14.

Note that, in the medium press portion 33, the medium guide portions 33*a* and 33*b* are provided at the positions where the ink jet head 14 does not pass, thereby being capable of employing a shape in which the medium guide portions 33*a* and 33*b* come to higher positions as approaching to the tips thereof. As a result, it is possible to facilitate the medium to be introduced and discharged. Further, in the first plate 31 and the second plate 32, the screws 34*a*, 35*a*, 36*a*, and 37*a* are arranged at regions where the ink jet head 14 does not pass.

The region at which ink is ejected from the ink jet head 14 corresponds to a region which is on the platen 15 and is sandwiched by the medium press device 20 and the medium press device 30. Therefore, in the ink ejection region, the medium may positively be restricted at least by the medium press devices 20 and 30, thereby being capable of the zigzag movement of the medium.

Hereinafter, description is made of a modification example thereof.

The medium press devices 20 and 30 may be arranged at arbitrary positions in the longitudinal direction of the platen 15. For example, in a state where outside force is not applied to the wire working springs 41 and 42, the first plate 31 may be brought into contact with the end portion of the width direction of the medium which is normally conveyed, or the end portion of the width direction of the medium may be covered with the medium press portion 33, though being not brought into contact with the first plate 31. In the case where the first plate 31 is disposed so as to contact with the end portion of the width direction of the medium, even if the medium slides in a direction being away from the first plate 31, the medium may be maintained to be held if being covered with the medium press portion 33.

Depending on the kinds of the medium or the other conditions, there may a case in which slant movement of the medium is liable to largely cause. In this case, however, if the first plate 31 is disposed so as to apply a force to the end portion of the medium, the holding of the medium is easily continued. Further, the positions of the medium press devices 20 and 30 are set so that the medium may be positively pressed at least a region at which the ink is ejected from the ink jet head.

Figure 13:
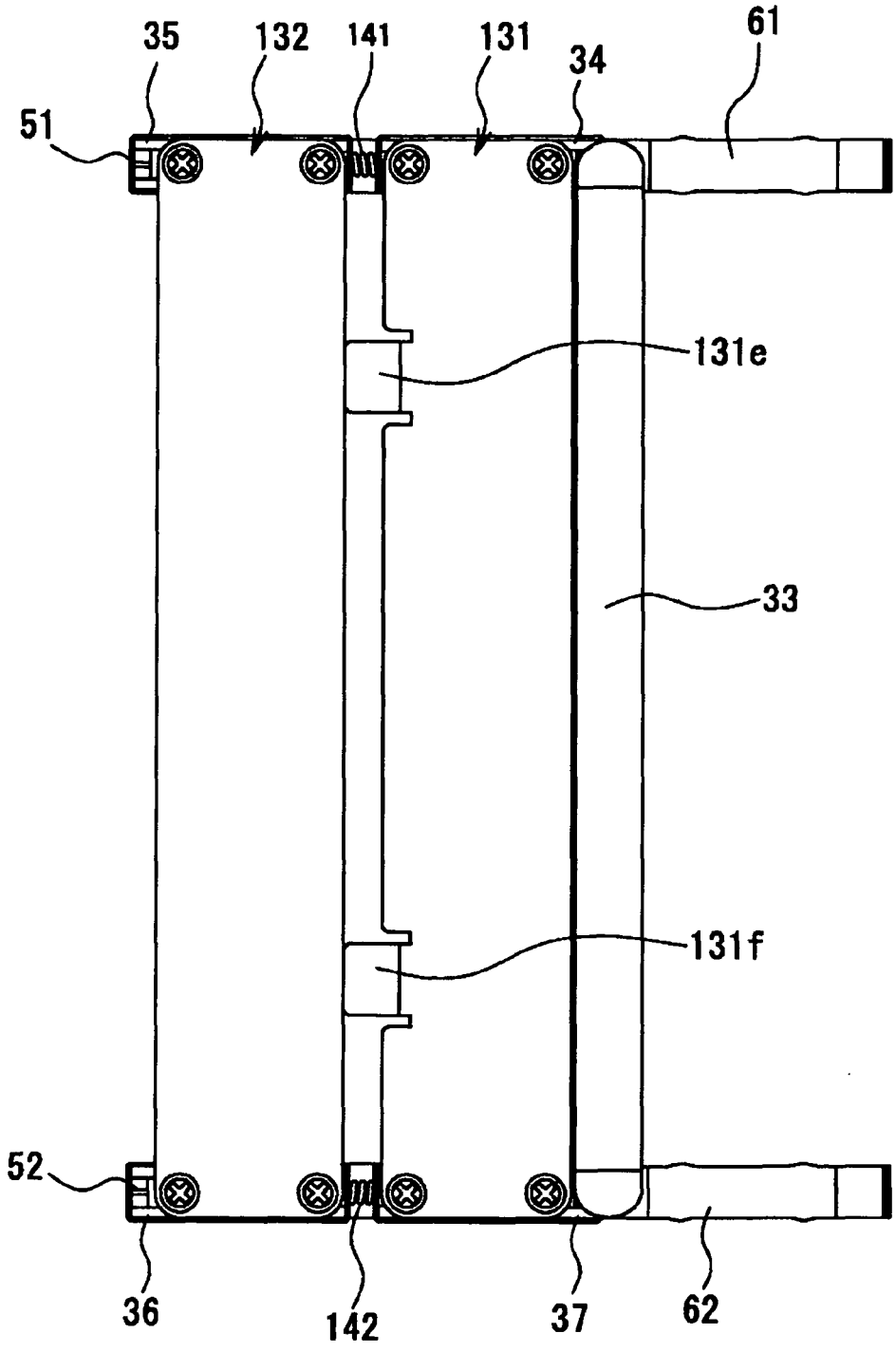
FIG. 13 A plan view illustrating the structure of the medium press device according to a modification example.

In the embodiment described above, by using the elastic force of the wire working springs 41 and 42 having a U-shape, the gap between the first plate 31 and the second plate 32 are made adjustable. In place of this, as illustrated in FIG. 13, the coil springs 141 and 142 may be disposed between the first plate 131 and the second plate 132. Here, FIG. 13 is a plan view illustrating the structure of the medium press device 130 according to a modification example. The first plate 131 and the second plate 132 correspond to the first plate 31 and the second plate 32, respectively, and the outer shapes when viewed planarly are the same with the first plate 31 and the second plate 32, and are formed with the same material. The tilting pieces 131*e* and 131*f* of the first plate 131 are constructed similar to the tilting pieces 31*e* and 31*f* of the first plate 31. In the medium press device 130, the same effects with that of the above-mentioned embodiment may be obtained. In addition, the engagement portions 31*a*, 31*b*, 31*c*, 31*d*, 32*a*, 32*b*, 32*c*, and 32*d* are not necessary to be formed on the first plate 31 and the second plate 32, and hence the processing cost thereof becomes unnecessary, resulting in enhancing the strength of the first plate 131 and the second plate 132. Further, the coil springs 141 and 142 are arranged at regions at which the ink jet head 14 does not pass as well as the screws 34*a*, 35*a*, 36*a*, and 37*a* and the medium guide portions 33*a* and 33*b*, the coil springs 141 and 142 are not brought into contact with the ink jet head 14, thereby being capable of increasing the diameters thereof.

Further, in place of the coil springs 141 and 142, a material equipped with elasticity such as sponge, rubber, felt, or the like may be used to adjust the gap between the first plate 31 and the second plate 32.

Further, in place of the plate springs 61 and 62, a material equipped with elasticity such as a coil spring, sponge, rubber, felt, or the like, or a member having a given frictional force may also be used. If the coil spring is adopted, for example, it is preferred that one end portion of the coil spring be abutted against the movement restriction portion 51*a* of the stopper blades 51 and the movement restriction portion 52*a* of the stopper blades 52, and another end portion of the coil spring be abutted against the wall separately provided, respectively.

Still further, in the above-mentioned embodiment, two U-shape springs as the wire working springs 41 and 42 are used. However, the shape of the spring and the number of the springs may arbitrary be set. For example, only one U-shape spring may be disposed at the center in the longitudinal direction of the first plate 31. Further, as the shape of the spring, for example, a V-shape or a rectangle shape may be employed other than the U-shape. In addition, even in the case where two U-shape springs are used, the two U-shape springs may be arranged so that the center side in the longitudinal direction of the first plate 31 is opened.

Further, between the first plate 31 and the movement restriction portion 51*b* of the stopper blades 51, and between the first plate 31 and the movement restriction portion 52*b* of the stopper blades 52, an elastic member such as a linear shape spring or a coil spring may be arranged. According to this structure, when the medium is normally conveyed, the elastic member is in the natural state. However, when the end portion in the width direction of the medium moves outside, the elastic member is compressed. Even in this case, too, in the case where the position in the width direction of the medium is displaced so extremely outside as exceeding the frictional force between the plate spring 62 and the inner wall of the groove portion 18, the entire medium press device 30 may de moved outside. With this, the breakage of the medium may be prevent.

Further, the medium press devices 20 and 30 were supported by the platen 15, but the medium press devices 20 and 30 may be supported other than the platen 15 by causing the plate springs 61 and 62 to be received in the groove portions 17 and 18, respectively.

Still further, there may also be provided a lock mechanism for switching on and off of the sliding of the medium press devices 20 and 30.

As constructed as described above, according to the above-mentioned embodiments, the following effects may be obtained.

(1) Irrespective of the conveying state of printing paper or other medium, it is possible to securely hold the both ends of the width direction thereof.

(2) Even in a case where a medium is conveyed diagonally or in a zigzag line, it is possible to keep pressing the ends of the medium, whereby it is possible to maintain a gap between an ink jet head 14 and the medium to a desired gap to keep a printing quality constant.

(3) The medium press devices 20 and 30 always cover the end portions of the width direction of the medium, whereby it is possible to prevent the printing quality from degrading due to floating of the end portions of the medium, curling, and influences caused by cutting trash and other foreign matter remained in the end portions of the medium.

(4) As the medium is not pressed strongly, it is possible to suppress breakage of the medium.

While the present invention was described with reference to the above-mentioned embodiments, but is not limited to the above-mentioned embodiments, and improvements and modifications may be possible for the purpose of improvements or within a scope of sprits of the present invention.

As described above, the medium press device according to the present invention is useful for an ink jet printer in which ink is ejected from an ink jet head to the medium, thereby forming an image, and is suited, in particular, to an inkjet printer in which the size of the medium is large, thereby being likely to cause the fluctuation of the conveying state thereof.

The invention claimed is:

1. A medium press device for holding a medium conveyed in a conveyance direction over a platen in an ink jet printer, the medium press device comprising:

a pair of press members for holding opposite side sections of a medium in a width direction thereof which is orthogonal to the conveyance direction, the press members being mounted to undergo movement in the width direction of the medium; and support tools for supporting the respective press members and permitting the press members to advance and retract in the width direction of the medium in accordance with positions of the side sections of the medium in the width direction, the support tools comprising:

two groove portions arranged in parallel with the platen along a longitudinal direction of the platen, one of the groove portions being arranged at the upstream side of the platen with respect to the conveyance direction of the medium and the other of the groove portions being arranged at the downstream side of the platen with respect to the conveyance direction of the medium, slider blocks fixed to each press member, some of the slider blocks being slidable along the inside of the one groove portion and others of the slider blocks being slidable along the inside of the other groove portion, and plate springs respectively connected to the slider blocks that are fixed to each press member and that are slidable along the one groove portion and plate springs respectively connected to the slider blocks that are fixed to each press member and that are slidable along the other groove portion, each plate spring being elastically pressed against an inner wall of its corresponding groove portion so that a frictional force is produced between the plate spring and the inner wall of the groove portion;

wherein the press members regulate movement of the medium in the width direction thereof.

2. A medium press device according to claim 1; wherein each of the support tools comprises an elastically deformable elastic support member and a hold tool for holding the elastic support member; and wherein each of the support tools supports the respective press member so that the press member is permitted to advance and retract in the width direction of the medium by an elastic force of the elastic support member.

3. A medium press device according to claim 2; wherein the hold tool is mounted to undergo sliding movement along the two groove portions in the width direction of the medium, the hold tool being in a non-movable state when a force received from the medium is within a predetermined range, and the hold tool undergoing sliding movement in the width direction of the medium when the force received from the medium exceeds the predetermined range.

4. A medium press device according to claim 3; wherein the hold tool comprises a hold member which is juxtaposed with the press member in the width direction of the medium and through the intermediation of the elastic support member.

5. A medium press device according to claim 4; wherein the hold tool further comprises a gap restriction member for regulating a gap between the corresponding press member and the hold member.

6. A medium press device according to claim 5; wherein the gap restriction member is mounted to undergo sliding movement along the two groove portions; and wherein the plate springs are elastically deformable in the width direction of the medium for regulating a sliding range of the gap restriction member by an elastic force of the plate springs.

7. A medium press device according to claim 6; wherein a sliding movement of each press member in the width direction of the medium is regulated through a resultant force of the elastic force of the corresponding plate spring and a frictional force between the corresponding plate spring and a movement restriction member of the ink jet printer; and wherein when a force received from the medium exceeds the resultant force, the press member slides in the width direction of the medium.

8. A medium press device according to claim 7; wherein each groove portion is formed in the movement restriction member and receives therein a respective plate spring in a state in which the the plate spring abuts against an inner wall of the groove portion so that the frictional force is produced between the plate spring and the inner wall of the groove portion.

9. A medium press device according to claim 7; wherein the movement restriction member is the platen of the ink jet printer.

10. A medium press device according to claim 2; wherein the elastic support member comprises a spring having elasticity in the width direction of the medium.

11. A medium press device according to claim 10; wherein the elastic support member is a spring having a generally linear shape.

12. An ink jet printer, comprising:

a medium conveying device for conveying a medium in a conveyance direction over a platen;

an ink jet head for discharging ink to the medium; and a medium press device according to claim 1 for holding the medium conveyed by the medium conveying device.

13. An ink jet printer according to claim 12; wherein each support tool comprises an elastically deformable elastic support member and a hold tool for holding the elastic support member; and wherein each support tool supports the respective press member so that the press member is permitted to advance and retract in the width direction of the medium by an elastic force of the elastic support member.

14. An ink jet printer according to claim 13; wherein the hold tool is mounted to undergo sliding movement along the two groove portions in the width direction of the medium, the hold tool being in a non-movable state when a force received from the medium is within a predetermined range, and the hold tool undergoing sliding movement in the width direction of the medium when the force received from the medium exceeds the predetermined range.

15. An ink jet printer according to claim 13; wherein the hold tool comprises a hold member positioned adjacent to the corresponding press member, and a gap restriction member for regulating a gap between the corresponding press member and the hold member.

16. An ink jet printer according to claim 15; wherein the gap restriction member is mounted to undergo sliding movement along the two groove portions; and wherein the plate springs are elastically deformable in the width direction of the medium for regulating a sliding range of the gap restriction member by an elastic force of the plate springs.

17. An ink jet printer according to claim 16; further comprising a movement restriction member for restricting movement of the plate springs; wherein a sliding movement of the corresponding press member in the width direction of the medium is regulated through a resultant force of the elastic force of the plate springs and a frictional force between the plate springs and the movement restriction member; and wherein when a force received from the medium exceeds the resultant force, the press member slides in the width direction of the medium.

18. An ink jet printer according to claim 17; wherein the two groove portions are formed in the movement restriction member and receive therein the plate springs in a state in which the plate springs abut against inner walls of the respective groove portions so that the frictional force is produced between the plate springs and the inner walls of the groove portions.

19. An ink jet printer according to claim 17; wherein the movement restriction member comprises the platen for supporting the print medium during movement of the medium along the medium conveying direction.

20. A printer comprising:

a medium conveying device for conveying a recording medium in a conveyance direction over a platen, the platen extending in a longitudinal direction orthogonal to the conveyance direction and having opposite end portions that are spaced apart in a width direction of the recording medium;

a print head for performing printing on the recording medium while it is positioned over the platen; and a device for holding the recording medium during its conveyance over the platen, the device comprising two press members, one at each end portion of the platen, for holding opposite side portions of the recording medium that are spaced apart in the width direction of the recording medium, the press members being slidable along groove portions provided in the platen so that the press members can slide toward and away from one another in the width direction of the recording medium, and spring members connected to the press members and elastically pressed against inner walls of the groove portions so that a frictional force is produced between the spring members and the corresponding inner walls of the groove portions to fix the press members against movement by a force exerted in the width direction by the recording medium.

21. A printer according to claim 20; wherein the platen is provided with two groove portions, one groove portion being positioned at the upstream side of the platen with respect to the conveyance direction of the recording medium and the other groove portion being positioned at the downstream side of the platen with respect to the conveyance direction of the recording medium.

22. A printer according to claim 20; wherein the groove portions are parallel to the longitudinal direction of the platen.

* * * * *